US007040703B2

(12) United States Patent
Sanchez

(10) Patent No.: US 7,040,703 B2
(45) Date of Patent: May 9, 2006

(54) HEALTH CHAIR A DYNAMICALLY BALANCED TASK CHAIR

(75) Inventor: Gary L. Sanchez, Albuquerque, NM (US)

(73) Assignee: Garrex LLC, Albuquerque, NM (US)

( * ) Notice: Subject to any disclaimer, the term of this patent is extended or adjusted under 35 U.S.C. 154(b) by 232 days.

(21) Appl. No.: 10/401,481

(22) Filed: Mar. 28, 2003

(65) Prior Publication Data

US 2003/0197407 A1 Oct. 23, 2003

Related U.S. Application Data

(60) Provisional application No. 60/368,157, filed on Mar. 29, 2002.

(51) Int. Cl.
*A47C 1/024* (2006.01)

(52) U.S. Cl. ..... 297/353; 297/284.1; 297/284.4; 297/354.12; 297/302.7

(58) Field of Classification Search ..... 297/353, 297/284.1, 284.4, 452.26, 452.29, 354.1, 297/354.12, 374, 302.5, 302.7, 300.8
See application file for complete search history.

(56) References Cited

U.S. PATENT DOCUMENTS

| | | | | |
|---|---|---|---|---|
| 567,096 | A | | 9/1896 | Harvey et al. |
| 1,007,985 | A | | 11/1911 | Smith |
| 1,414,637 | A | | 5/1922 | Gell |
| 2,060,298 | A | | 11/1936 | Gailey |
| 2,182,598 | A | | 12/1939 | Owler |
| 2,304,349 | A | | 12/1942 | Fox |
| 2,712,346 | A | | 7/1955 | Sprinkle |
| 2,859,797 | A | | 11/1958 | Mitchelson |
| 2,859,801 | A | | 11/1958 | Moore |
| 3,015,148 | A | | 1/1962 | Haddad |
| 3,041,109 | A | | 6/1962 | Eames et al. |
| 3,059,971 | A | * | 10/1962 | Otto ..... 297/353 |
| 3,072,436 | A | | 1/1963 | Moore |
| 3,107,991 | A | | 10/1963 | Taussig |
| 3,112,987 | A | | 12/1963 | Griffiths et al. |
| 3,115,678 | A | | 12/1963 | Keen et al. |
| 3,124,092 | A | | 3/1964 | Raynes |
| 3,124,328 | A | | 3/1964 | Kortsch |
| 3,165,359 | A | | 1/1965 | Ashkouti |
| 3,208,085 | A | | 9/1965 | Grimshaw |
| 3,214,314 | A | | 10/1965 | Rowbottam |
| 3,248,147 | A | | 4/1966 | Testa |
| 3,273,877 | A | | 9/1966 | Geller et al. |
| 3,298,743 | A | | 1/1967 | Albinson et al. |
| 3,301,931 | A | | 1/1967 | Morin |
| 3,314,721 | A | | 4/1967 | Smith |
| 3,333,811 | A | | 8/1967 | Matthews |
| 3,337,267 | A | | 8/1967 | Rogers, Jr. |
| 3,399,926 | A | | 9/1968 | Hehn |
| 3,431,022 | A | | 3/1969 | Poppe et al. |
| 3,434,181 | A | | 3/1969 | Benzies |
| 3,436,048 | A | | 4/1969 | Greer |
| 3,534,129 | A | | 10/1970 | Bartel |
| 3,544,163 | A | | 12/1970 | Krein |
| 3,589,967 | A | | 6/1971 | Shirakawa |

(Continued)

*Primary Examiner*—Peter R. Brown
(74) *Attorney, Agent, or Firm*—Deborah A. Peacock; Peacock Myers, P.C.

(57) ABSTRACT

Healthy task seating is achieved by integrating three dynamics into a unique, dynamically balanced chair design that provides: (a) adaptable design features to accommodate a wide range of body dimensions, (b) a series of independent and adjustable support means to accommodate a wide range of tasks, and (c) means for promoting active seating.

18 Claims, 14 Drawing Sheets

U.S. PATENT DOCUMENTS

| | | | | |
|---|---|---|---|---|
| 3,601,446 | A | | 8/1971 | Persson |
| 3,624,814 | A | | 11/1971 | Borichevsky |
| 3,640,576 | A | | 2/1972 | Morrison et al. |
| 3,758,356 | A | | 9/1973 | Hardy |
| 3,807,147 | A | | 4/1974 | Schoonen |
| 3,817,806 | A | | 6/1974 | Anderson et al. |
| 3,844,612 | A | | 10/1974 | Borggren et al. |
| 3,864,265 | A | | 2/1975 | Markley |
| 3,880,463 | A | | 4/1975 | Shephard et al. |
| 3,902,536 | A | | 9/1975 | Schmidt |
| 3,915,775 | A | | 10/1975 | Davis |
| 3,932,252 | A | | 1/1976 | Woods |
| 3,947,068 | A | | 3/1976 | Buhk |
| 3,961,001 | A | | 6/1976 | Bethe |
| 3,965,944 | A | | 6/1976 | Goff, Jr. et al. |
| 3,999,802 | A | | 12/1976 | Powers |
| 4,008,029 | A | | 2/1977 | Shokite |
| 4,010,980 | A | | 3/1977 | Dubinsky |
| 4,013,257 | A | | 3/1977 | Paquette |
| 4,018,479 | A | | 4/1977 | Ball |
| 4,019,776 | A | | 4/1977 | Takamatsu |
| 4,036,524 | A | | 7/1977 | Takamatsu |
| 4,046,611 | A | | 9/1977 | Sanson |
| 4,047,756 | A | | 9/1977 | Ney |
| 4,062,590 | A | | 12/1977 | Polsky et al. |
| 4,067,249 | A | | 1/1978 | Deucher |
| 4,087,224 | A | | 5/1978 | Moser |
| 4,107,371 | A | | 8/1978 | Dean |
| 4,108,416 | A | | 8/1978 | Nagase et al. |
| 4,113,627 | A | | 9/1978 | Leason |
| 4,116,736 | A | | 9/1978 | Sanson et al. |
| 4,125,490 | A | | 11/1978 | Hettinga |
| 4,149,919 | A | | 4/1979 | Lea et al. |
| 4,152,023 | A | | 5/1979 | Buhk |
| 4,161,504 | A | | 7/1979 | Baldini |
| 4,174,245 | A | | 11/1979 | Martineau |
| 4,189,880 | A | | 2/1980 | Ballin |
| 4,190,286 | A | | 2/1980 | Bentley |
| 4,299,645 | A | | 11/1981 | Newsom |
| 4,302,048 | A | | 11/1981 | Yount |
| 4,314,728 | A | | 2/1982 | Faiks |
| 4,336,220 | A | | 6/1982 | Takahashi |
| 4,339,488 | A | | 7/1982 | Brokmann |
| 4,364,887 | A | | 12/1982 | Becht et al. |
| 4,373,692 | A | | 2/1983 | Knoblauch et al. |
| 4,375,301 | A | | 3/1983 | Pergler et al. |
| 4,380,352 | A | | 4/1983 | Diffrient |
| 4,390,206 | A | | 6/1983 | Faiks et al. |
| 4,411,469 | A | | 10/1983 | Drabert et al. |
| 4,429,917 | A | | 2/1984 | Diffrient |
| 4,438,898 | A | | 3/1984 | Knoblauch et al. |
| 4,465,435 | A | | 8/1984 | Copas |
| 4,469,738 | A | | 9/1984 | Himelreich, Jr. |
| 4,469,739 | A | | 9/1984 | Gretzinger et al. |
| 4,494,795 | A | | 1/1985 | Roossien et al. |
| 4,502,729 | A | | 3/1985 | Locher |
| 4,522,444 | A | | 6/1985 | Pollock |
| 4,529,247 | A | | 7/1985 | Stumpf et al. |
| 4,545,614 | A | | 10/1985 | Abu-Isa et al. |
| 4,548,441 | A | | 10/1985 | Ogg |
| 4,568,455 | A | | 2/1986 | Huber et al. |
| 4,575,150 | A | | 3/1986 | Smith |
| 4,595,237 | A | | 6/1986 | Nelsen |
| 4,601,516 | A | | 7/1986 | Klein |
| 4,611,851 | A | | 9/1986 | Noyes et al. |
| 4,629,249 | A | | 12/1986 | Yamaguchi |
| 4,629,525 | A | | 12/1986 | Rasmussen |
| 4,634,178 | A | | 1/1987 | Carney |
| 4,638,679 | A | | 1/1987 | Tannenlaufer |
| 4,640,547 | A | | 2/1987 | Fromme |
| 4,643,481 | A | * | 2/1987 | Saloff et al. ..... 297/452.25 |
| 4,653,806 | A | | 3/1987 | Willi |
| 4,666,121 | A | | 5/1987 | Choong et al. |
| 4,668,012 | A | | 5/1987 | Locher |
| 4,670,072 | A | | 6/1987 | Pastor et al. |
| 4,691,961 | A | | 9/1987 | Rogers, Jr. et al. |
| 4,703,974 | A | | 11/1987 | Braeuning |
| 4,709,443 | A | | 12/1987 | Bigley |
| 4,709,962 | A | | 12/1987 | Steinmann |
| 4,720,142 | A | | 1/1988 | Holdredge et al. |
| 4,743,323 | A | | 5/1988 | Hettinga |
| 4,761,033 | A | | 8/1988 | Lanuzzi et al. |
| 4,763,950 | A | | 8/1988 | Tobler |
| 4,776,633 | A | | 10/1988 | Knoblock et al. |
| 4,779,925 | A | | 10/1988 | Heinzel |
| 4,793,197 | A | | 12/1988 | Petrovsky |
| 4,796,950 | A | | 1/1989 | Mrotz, III et al. |
| 4,796,955 | A | | 1/1989 | Williams |
| 4,803,118 | A | | 2/1989 | Sogi et al. |
| 4,815,499 | A | | 3/1989 | Johnson |
| 4,815,789 | A | | 3/1989 | Marcus |
| 4,819,458 | A | | 4/1989 | Kavesh et al. |
| 4,826,249 | A | | 5/1989 | Bradbury |
| 4,829,644 | A | | 5/1989 | Kondo et al. |
| 4,830,697 | A | | 5/1989 | Aizawa |
| 4,831,697 | A | | 5/1989 | Urai |
| 4,842,257 | A | | 6/1989 | Abu-Isa et al. |
| 4,846,230 | A | | 7/1989 | Mock et al. |
| 4,852,228 | A | | 8/1989 | Zeilinger |
| 4,860,415 | A | | 8/1989 | Witzke |
| 4,861,106 | A | | 8/1989 | Sondergeld |
| 4,869,554 | A | | 9/1989 | Abu-Isa et al. |
| 4,885,827 | A | | 12/1989 | Williams |
| 4,889,384 | A | | 12/1989 | Sulzer |
| 4,889,385 | A | | 12/1989 | Chadwick et al. |
| 4,892,254 | A | | 1/1990 | Schneider et al. |
| 4,902,069 | A | | 2/1990 | Lehnert |
| 4,904,430 | A | | 2/1990 | Yamada |
| 4,906,045 | A | | 3/1990 | Hofman |
| 4,927,698 | A | | 5/1990 | Jaco et al. |
| 4,939,183 | A | | 7/1990 | Abu-Isa et al. |
| 4,942,006 | A | | 7/1990 | Loren |
| 4,943,115 | A | | 7/1990 | Stucki |
| 4,946,224 | A | | 8/1990 | Leib |
| 4,961,610 | A | | 10/1990 | Reeder et al. |
| 4,966,411 | A | | 10/1990 | Katagiri et al. |
| 4,968,366 | A | | 11/1990 | Hukki et al. |
| 4,979,778 | A | | 12/1990 | Shields |
| 4,981,325 | A | | 1/1991 | Zacharkow |
| 4,981,326 | A | | 1/1991 | Heidmann |
| 4,986,948 | A | | 1/1991 | Komiya et al. |
| 4,988,145 | A | | 1/1991 | Engel |
| 5,000,515 | A | | 3/1991 | Deview |
| 5,009,827 | A | | 4/1991 | Abu-Isa et al. |
| 5,009,955 | A | | 4/1991 | Abu-Isa |
| 5,013,089 | A | | 5/1991 | Abu-Isa et al. |
| 5,015,034 | A | | 5/1991 | Kindig et al. |
| 5,029,940 | A | | 7/1991 | Golynsky et al. |
| 5,033,791 | A | | 7/1991 | Locher |
| 5,070,915 | A | | 12/1991 | Kalin |
| 5,071,189 | A | | 12/1991 | Kratz |
| 5,096,652 | A | | 3/1992 | Uchiyama et al. |
| 5,100,713 | A | | 3/1992 | Homma et al. |
| 5,106,678 | A | | 4/1992 | Abu-Isa |
| 5,107,720 | A | | 4/1992 | Hatfield |
| 5,114,211 | A | | 5/1992 | Desanta |
| 5,116,556 | A | | 5/1992 | Danton |
| 5,117,865 | A | | 6/1992 | Lee |
| 5,135,694 | A | | 8/1992 | Akahane et al. |
| 5,143,422 | A | | 9/1992 | Althofer et al. |
| 5,153,049 | A | | 10/1992 | Groshens |
| 5,228,747 | A | * | 7/1993 | Greene ..... 297/284.3 |
| 5,240,308 | A | | 8/1993 | Goldstein et al. |

5,288,130 A * 2/1994 Foster ..... 297/411.36
5,288,135 A * 2/1994 Forcier et al. ..... 297/452.21
5,407,248 A 4/1995 Jay et al.
5,501,507 A * 3/1996 Hummitzsch ..... 297/284.4
5,547,251 A * 8/1996 Axelson ..... 297/284.5
5,678,891 A 10/1997 O'Neill et al.
5,679,891 A 10/1997 Matsuno et al.
5,704,689 A * 1/1998 Kim ..... 297/301.4
6,079,782 A 6/2000 Berg et al.
6,089,664 A 7/2000 Yoshida
6,095,611 A 8/2000 Bar et al.
6,152,532 A 11/2000 Cosentino
6,189,971 B1 2/2001 Witzig
6,193,313 B1 2/2001 Jonsson
6,254,186 B1 7/2001 Falzon
6,334,650 B1 1/2002 Chien-Chuan
6,334,651 B1 1/2002 Duan et al.
6,338,530 B1 1/2002 Gowing
6,352,307 B1 3/2002 Engman
6,386,634 B1 5/2002 Stumpf et al.
6,431,648 B1 8/2002 Cosentino et al.
6,447,061 B1 9/2002 Klingler
6,478,379 B1 11/2002 Ambasz
6,499,802 B1 12/2002 Drira

* cited by examiner

HEALTH CHAIR A DYNAMICALLY BALANCED TASK CHAIR

DOMESTIC PRIORITY CLAIM

This application claims domestic priority under 35 U.S.C. 119(e) from commonly owned provisional application Ser. No. 60/368,157, filed Mar. 29 2002, the disclosure of which is hereby incorporated herein by reference.

BACKGROUND OF THE INVENTION

The present invention relates generally to task chairs which dynamically support the body of the user in healthy positions while performing various tasks over extended seating periods.

In the past century, much of the industrialized world has dramatically changed. Inventions have altered the way work is performed. At the turn of the $20^{th}$ century, work was more physical, active and erect. At the close of the $20^{th}$ century, the average worker has less physical activity and the worker performs more of their work in a seated position.

Anatomical science teaches that if any part of anatomical function is impinged or static for periods of time, dysfunction (poor health) will result. Dysfunction restricts the ability to animate. Limited animation eventually leads to poor health. Good health will optimize performance and quality of life.

In the mid-1980s, new health problems became evident as industrial society was becoming more and more sedentary and good health was on the decline. Society was advised to become more active. Aerobics, jazzercise, weight training, various types of workouts and physical activities of all kinds were encouraged. Many working professionals responded and incorporated physical activity into their daily routine.

Yet while health improved for some, many others either chose not to incorporate physical activity in their schedule, or were unable to because of schedule restraints. With many in our society being both providers and caretakers of the family, opportunity for scheduled physical activity is limited.

People from both groups, those with physical activity and those without, were having similar health issues. A common denominator was determined to be seating doing tasks for long periods of time at work and/or at home. Many experienced lower back pain, muscle tension, numbness, acid reflux, carpel tunnel syndrome and general fatigue.

Peter Escogue, a recognized anatomical functionalist, suggests these problems are posture related as well as inactivity related. Proper anatomical posture promotes proper anatomical function, i.e. the body functions best when operated from a proper position. Escogue further observes that over a period of time, many have compromised their correct posture, therefore compromising correct function. The discomfort symptoms are the body's way of alerting us that function is impinged by an improper posture.

Static improper posture, while sitting in a static improper supporting chair, causes poor seating health. Originally sitting, especially chairs, were designed for two separate purposes:

A place to rest from activity. The erect active worker looked to sit (atop, rest, relax) in a comfort giving chair, like the Lazy Boy® recliner. A chair as a work device. Function, not comfort, was primary, like a stool.

Later, chair manufacturers saw the need for something different for the seated worker, thus, the creation of the task chair. The natural progression was to combine both into one.

Work chairs got pads, tilts, swivels, etc. Over time, health improvements were added to the combination of the family room recliners and the worker's rigid elevating stool. Additions like lumbar supports, adjustable armrests, shaping of seat back to a general vertebrae contour, etc., were included.

Evolving task chairs combined elements from comfort chairs with a worker's stool. The addition of health features continually posed a compromise between comfort and the task. Today's combination task chairs offer few features to accommodate multiple tasks with little consideration for seating health.

Task chairs are typically configured to allow tilting of the seat and backrest as a unit or tilting of the backrest relative to the seat. In chairs having a backrest pivotally attached to a seat in a conventional manner, the movement of the backrest relative to the seat can create shear forces acting on the legs and back of the user. These shear forces tend to cause an uncomfortable pulling of the user's clothing. In an attempt to compensate for these shear forces, some office chairs include a backrest which pivots while the seat tilts, such as those disclosed in U.S. Pat. No. 2,859,801 (Moore) and U.S. Pat. No. 4,429,917 (Diffrient).

A related disadvantage of conventional task chairs is the configuration of the seat and/or backrest. Such seats typically include single or multi-density foam padding with a covering such as cloth, leather, mesh material or the like. Such seating also tends to provide insufficient aeration since it acts as another layer of clothing and does not contain a Spinal Relief Channel in the back support, and/or contain a Coccyx Relief in the horizontal seat. In addition, the structural requirements of such an attachment limits the shape and size of the frame and the membrane.

Typically, the seats of office task chairs are supported by a single stage telescoping column which provides for vertical adjustment of the seat. These columns include a gas spring mounted in a telescoping tube which is slidable within a base tube. In accordance with guidelines set by the American National Standards Institute (A.N.S.I.) and Business and Institutional Furniture Manufacturer's Association (B.I.F.M.A.), conventional office chairs in the United States are typically adjustable from a seat height of 16.0 inches from a floor to about 20.5 inches from a floor. Nevertheless, it is desirable to exceed this range of height adjustment to account for very small or large users and to accommodate the international population in general.

Typically, it is difficult to exceed this range of height adjustment with seats which tilt about the knees or ankles of the user. To offset the moments acting on single stage support columns, pneumatic manufacturers typically set a minimum overlapping distance of 2.95 inches (75 mm) between the tubes. Because such "ankle tilt" and "knee tilt" chairs have relatively large tilt housings, it is difficult to provide a lower minimum and higher maximum seat height while maintaining the required overlapping distance between the tubes. These types of tilting chairs also impart a greater moment on the tube since the pivot axis is offset from the support column. It is therefore desirable to provide a vertically adjustable support column having a greater overlapping distance to permit a greater stroke which decreases the minimum height and increases the maximum height of a chair seat.

INFORMATION DISCLOSURE

Relevant task chairs in the prior art include U.S. Pat. Nos. 6,386,634; 3,015,148; 3,041,109; 3,072,436; 3,107,991; 3,112,987; 3,115,678; 3,124,092; 3,124,328; 3,165,359;

3,208,085; 3,214,314; 3,248,147; 3,273,877; 3,298,743; 3,301,931; 3,314,721; 3,333,811; 3,337,267; 3,399,926; 3,431,022; 3,434,181; 3,436,048; 3,534,129; 3,544,163; 3,589,967; 3,601,446; 3,624,814; 3,640,576; 3,758,356; 3,807,147; 3,817,806; 3,844,612; 3,864,265; 3,902,536; 3,915,775; 3,932,252; 3,947,068; 3,961,001; 3,965,944; 3,999,802; 4,008,029; 4,010,980; 4,013,257; 4,018,479; 4,019,776; 4,036,524; 4,046,611; 4,047,756; 4,062,590; 4,067,249; 4,087,224; 4,107,371; 4,108,416; 4,113,627; 4,116,736; 4,125,490; 4,149,919; 4,152,023; 4,161,504; 4,174,245; 4,189,880; 4,299,645; 4,302,048; 4,314,728; 4,336,220; 4,339,488; 4,364,887; 4,373,692; 4,375,301; 4,380,352; 4,390,206; 4,411,469; 4,429,917; 4,438,898; 4,465,435; 4,469,738; 4,469,739; 4,494,795; 4,502,729; 4,522,444; 4,529,247; 4,545,614; 4,548,441; 4,568,455; 4,575,150; 4,595,237; 4,601,516; 4,611,851; 4,629,249; 4,629,525; 4,634,178; 4,638,679; 4,640,547; 4,653,806; 4,666,121; 4,668,012; 4,670,072; 4,709,443; 4,709,962; 4,720,142; 4,743,323; 4,761,033; 4,763,950; 4,776,633; 4,779,925; 4,793,197; 4,796,950; 4,796,955; 4,803,118; 4,815,499; 4,815,789; 4,819,458; 4,826,249; 4,829,644; 4,830,697; 4,831,697; 4,842,257; 4,846,230; 4,852,228; 4,860,415; 4,861,106; 4,869,554; 4,885,827; 4,889,384; 4,889,385; 4,892,254; 4,904,430; 4,906,045; 4,927,698; 4,939,183; 4,942,006; 4,943,115; 4,946,224; 4,961,610; 4,966,411; 4,968,366; 4,979,778; 4,981,326; 4,986,948; 4,988,145; 5,000,515; 5,009,827; 5,009,955; 5,013,089; 5,015,034; 5,029,940; 5,033,791; 5,070,915; 5,0711,189; 5,096,652; 5,100,713; 5,106,678; 5,107,720; 5,114,211; 5,116,556; 5,117,865; 5,135,694; 5,143,422; and 5,153,049. The disclosures of these patents are hereby incorporated herein by reference.

The prior art referenced above discloses a wide range of task chairs. Unfortunately, the various posterior supports disclosed by all task chairs in the prior art generally call for a series of interdependent posterior support means. While offering varying shapes, contours, masses and sizes, as well as a wide range of adjustment means, i.e. pivotal, tilt, height, in/out, up/down, soft/firm, etc., all attempts at healthy task chairs are burdened with an interdependent posterior design support which ultimately restricts and compromises adjustability, dynamic support and active seating.

The following U.S. patents generally teach a plurality of adjustable means: U.S. Pat. Nos. 6,478,379; 6,189,971; 6,152,532; 6,095,611; 6,089,664; 6,079,782; 5,679,891; and 5,407,248. The disclosures of these patents are hereby incorporated herein by reference.

The following U.S. patents are generally directed to various seat and back units with means for altering the contour: U.S. Pat. Nos. 6,499,802; 6,447,061; 6,431,648; 6,352,307; 6,338,530; 6,334,651; 6,334,650; 6,254,186; 6,193,313; 6,189,971; and 6,152,532. The disclosures of these patents are hereby incorporated herein by reference.

Other U.S. patents of interest include: U.S. Pat. Nos. 1,007,985; 2,304,349; 2,859,797; 4,691,961; 2,182,598; 4,981,325; 3,880,463; 4,902,069; 1,414,637; 2,712,346; 567,096; 2,060,298; 6,079,782; 5,678,891; 5,407,248; 5,240,308; 6,254,186; 6,193,313; 6,152,532; and 4,190,286. The disclosures of these patents are hereby incorporated herein by reference.

While the task chairs of the prior art offer some advantages, the chair industry clearly needs a dynamically balanced chair that provides healthy seating through posterior support, continuous animation and task function support. The present invention delivers such a chair.

OBJECTS OF THE INVENTION

Therefore, one object of the present invention is to provide a healthy task seating system.

Another object of the invention is to integrate three dynamics into a dynamically balanced task chair that provides adaptable design features to accommodate a wide range of body dimensions, a series of independent and adjustable support means to accommodate a wide range of tasks and mean for promoting active seating.

Yet another object of the invention is to provide a healthy task chair to support multiple tasks over extended seating periods.

Still another object of the invention is to provide a healthy task chair that supports proper anatomical posture and function with proper skeletal support.

Another object of the invention is to replace extended static seating and the resultant anatomical pressures and dysfunctions with a dynamically balanced task chair that supports continuous position animation and active seating.

Yet another object of the invention is to provide a dynamically balanced task chair that has the flexibility to support a wide range of seated tasks.

Still another object of the invention is to provide a health system for carrying out various tasks in a seated position.

Another object of the invention is to provide proper aeration along the spine from sacrum to cervix.

Yet another object of the invention is to provide a method for achieving healthy seating while carrying out a wide range of tasks.

Still another object of the chair is provide a method to maintain vertebrae strength contour.

Another object of the invention is to provide relief to spinous process to promote circulation and unimpingement.

Another object of the invention is to provide a method for manufacturing a wide range of dynamically balanced task chairs.

SUMMARY OF THE INVENTION

The adjustable task chair of the present invention has been developed to provide healthy muscle/skeletal/anatomical support to the user while performing a wide range of tasks in a seated position.

The adjustable task chair of the present invention dynamically integrates three key support elements simultaneously:

Adjustable Posterior Support, which provides a series of independent bracing supports anywhere along the line of vertebrae from the sacrum to the cervix. Two or more independent, adjustable, hinged, spring arms are secured to and arise from the seating frame, seat support, seat pedestal, or seat. One or more brace supports attach to these arms, each brace support has flexible adjustments in order to accommodate individual user dimensions. This arrangement of a series of independent hinged, spring arms with adjustable brace supports allows the user to participate in a wide range of tasks with optimum and healthy muscle/skeletal support.

Flexible Task Support provides flexibility through adaptability. For example, when the user requires anterior (forward) support, the seating can be reversed with the Flexible Posterior Supports described in (1) above adjusted to accommodate forward tasks. Should the user require elbow and lower arm support, adjustable forearm support members are provided to support vertical and lateral task movements. These forearm support members, in sync with the Flexible Posterior Support means, move up and down, inwardly and outwardly, while allowing for downward tilting from posterior to anterior to support tasks such as typing which calls fro a relaxed upper arm and shoulder combined with support at the elbow while allowing lower arm, wrist and hand to be in straight alignment angled downwardly from the elbow. This dynamic posture support from the chair of the present invention helps prevent carpel tunnel syndrome.

Continuous Position Animation, which provides for frequent repositioning by the user regularly readjusting the support members described in (1) and (2) above to affect periodic, slight anatomical movement of muscoloskeletal, respiratory, nervous, digestive and circulatory systems in order for these systems to remain uncompromised and unimpinged. This periodic slight repositioning of the various support members allows muscles to relax while redistributing anatomical pressure.

These three elements are dynamically integrated to respond in concert to a myriad of user sizes and shapes and a wide variety of chair-based tasks with a healthy muscle/skeletal support system.

Accordingly, one embodiment of the present invention is directed to an adjustable task chair suitable for providing active seating while dynamically supporting the body of the user during performance of various tasks from a seated position, comprising:

a base member a seat member having a seating surface supported by a frame member having anterior and posterior sections thereof, and at least two adjustable back support members, each secured independently to the posterior section of said seat frame member, wherein, a linkage assembly connects said seat frame member and said forearm support members to said base member, wherein said back members comprise independently hinged adjustable spring arm members, each provided with a vertically adjustable brace support members wherein each spring arm member is independently and hingedly secured to the posterior section of said seating frame member, thereby providing anterior and posterior adjustments to said horizontal brace support members which are secured to said spring arm members.

Advantageously, the chair of the present invention further comprises two adjustable forearm support members, wherein said forearm support members are dynamically integrated with said back support members while providing vertical and lateral adjustable means relative to said seat member seating surface.

Advantageously, the chair of the present invention further comprises a dynamically integrated, anatomical pressure relief means, which periodically signals the chair user to adjust said back support and said forearm support members in order to achieve active seating.

Advantageously, the chair of the present invention further comprises a seat member seating surface further comprises coccyx pressure relief means.

Advantageously, the chair of the present invention further comprises a spinal relief channel in each vertically adjustable brace support member.

Another embodiment of the present invention is directed to a healthy task seating system comprising:

a base member, a seat member with a seat frame member and at least two or more adjustable back support members selected from the group consisting of:

(a) adjustable exo-skeleton posterior support means, (b) a flexible task support means, and (c) a continuous position animation means, wherein said adjustable back support members are integrated to promote healthy seating while the user is performing various tasks from a seating position.

Advantageously, the healthy task seating system of the present invention further comprises at least two of said posterior support means, each of which is adjustable independently and hingedly secured to the posterior section of said seat frame member and are sufficiently flexible to accommodate a wide range of body dimensions with integrated dynamic support.

Preferably, the healthy task seating system of the present invention further comprises adjustable forearm support members that are dynamically integrated with said back support members while also providing vertical, lateral, and tilt adjustment to said forearm support members.

Preferably, the healthy task seating system of the present invention further comprises continuous position animation means to implement active seating by periodically adjusting the various adjustable support means.

Preferably, the healthy task seating system of the present invention further comprises an exo-skeleton posterior support means such as an adjustable, contoured, hinged, horizontal sacrum/lumbar cradle support means to provide horizontal support to the sacral region of the spine. Preferably, the sacrum/lumbar cradle support means comprises a sacrum/lumbar rocker arm member.

Preferably, the healthy task seating system of the present invention further comprises an exo-skeleton posterior support means comprising an adjustable, contoured, winged support brace member for supporting the thoracic/cervix region of the spine. Preferably, the thoracic/cervix winged support brace means comprises a thoracic/cervix rocker arm member.

Preferably, the present invention provides a bi-thorumix, dynamically balanced task chair comprising two adjustable posterior support means, one comprising a rocker arm thoracic/cervix suspending cradle supports means, and the other comprising a rocker arm sacrum/lumbar suspending cradle support means.

Another embodiment of the present invention is an adjustable task chair suitable for providing active seating while dynamically supporting the body of the user during performance of various tasks from a seated position, comprising:

(a) a base member, (b) a seat member having a seating surface supported by a said base member, (c) at least two adjustable back support members, each secured independently to the posterior section of said seat frame member, and two adjustable forearm support members, wherein:

said back members comprise independently adjustable spring arm members, each provided with an adjustable, horizontal brace support members wherein each spring arm member is independently secured to the base member, thereby providing anterior and posterior adjustments to said horizontal brace support members which are secured to said spring arm members, and two adjustable forearm support members, wherein said forearm support members are dynamically integrated with said back support members while providing vertical and lateral adjustable means relative to said seat member seating surface.

Preferably, this embodiment of the present invention further comprises a dynamically integrated, anatomical pressure relief means, which periodically signals the chair user to adjust said back support and said forearm support means in order to achieve active seating. Preferably, each adjustable, horizontal brace support member comprises a spinal relief channel. Preferably, said seat member seating surface further comprises coccyx pressure relief means.

DEFINITIONS

Figure 1:
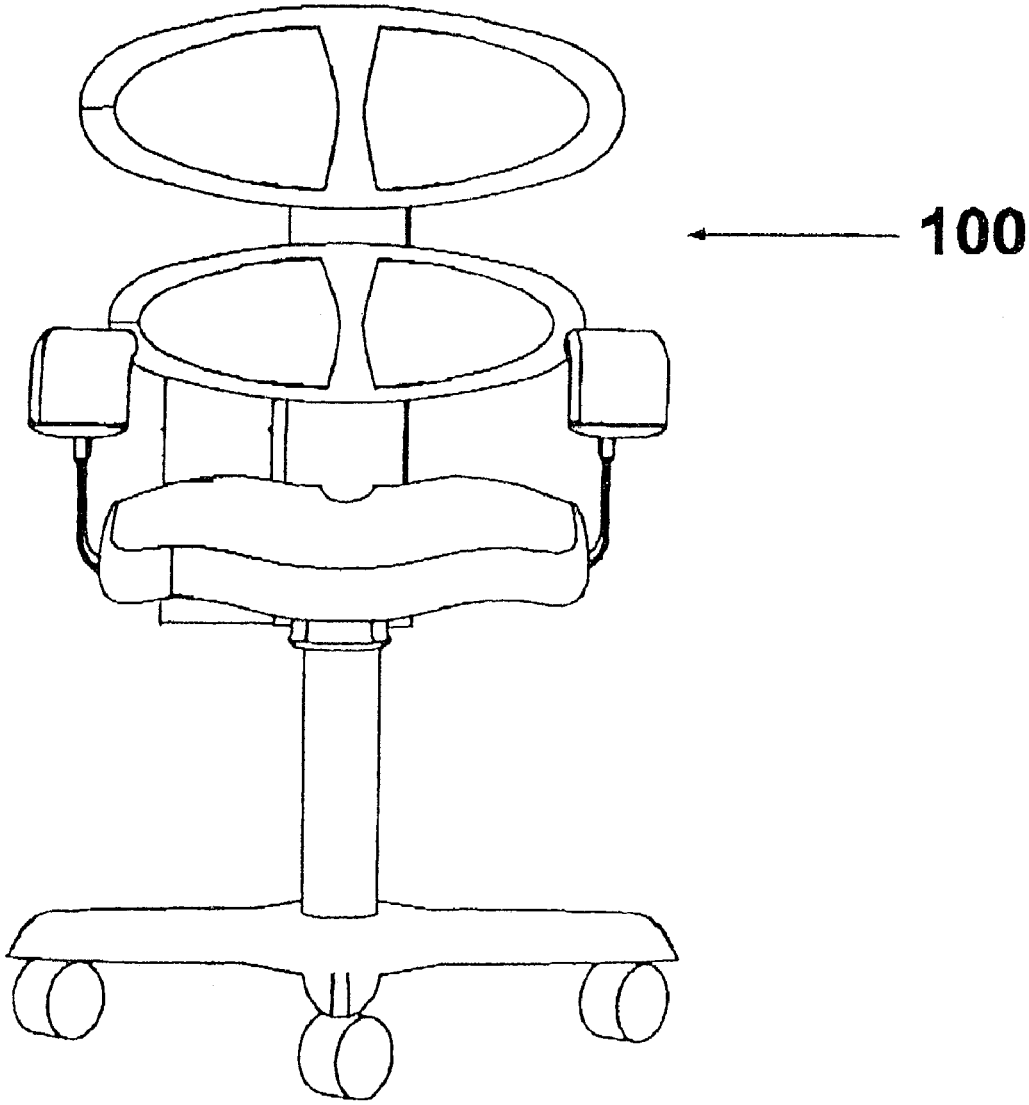
FIG. 1 is a front view of a preferred chair of the present invention 100, illustrating two independent posterior support means.
Figure 2:
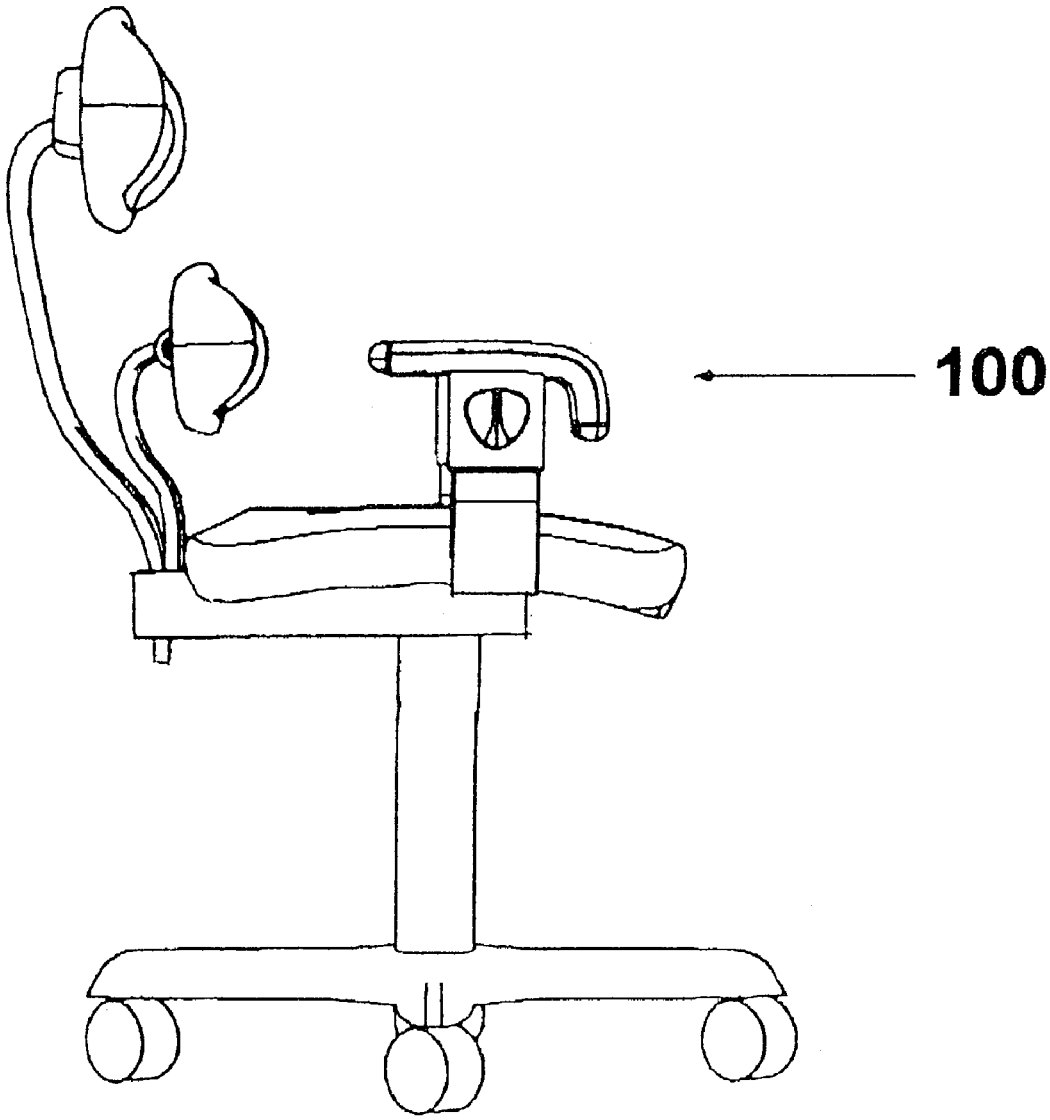
FIG. 2 is a side view of the chair of FIG. 1, illustrating two independent posterior support means with common hinge means.
Figure 3:
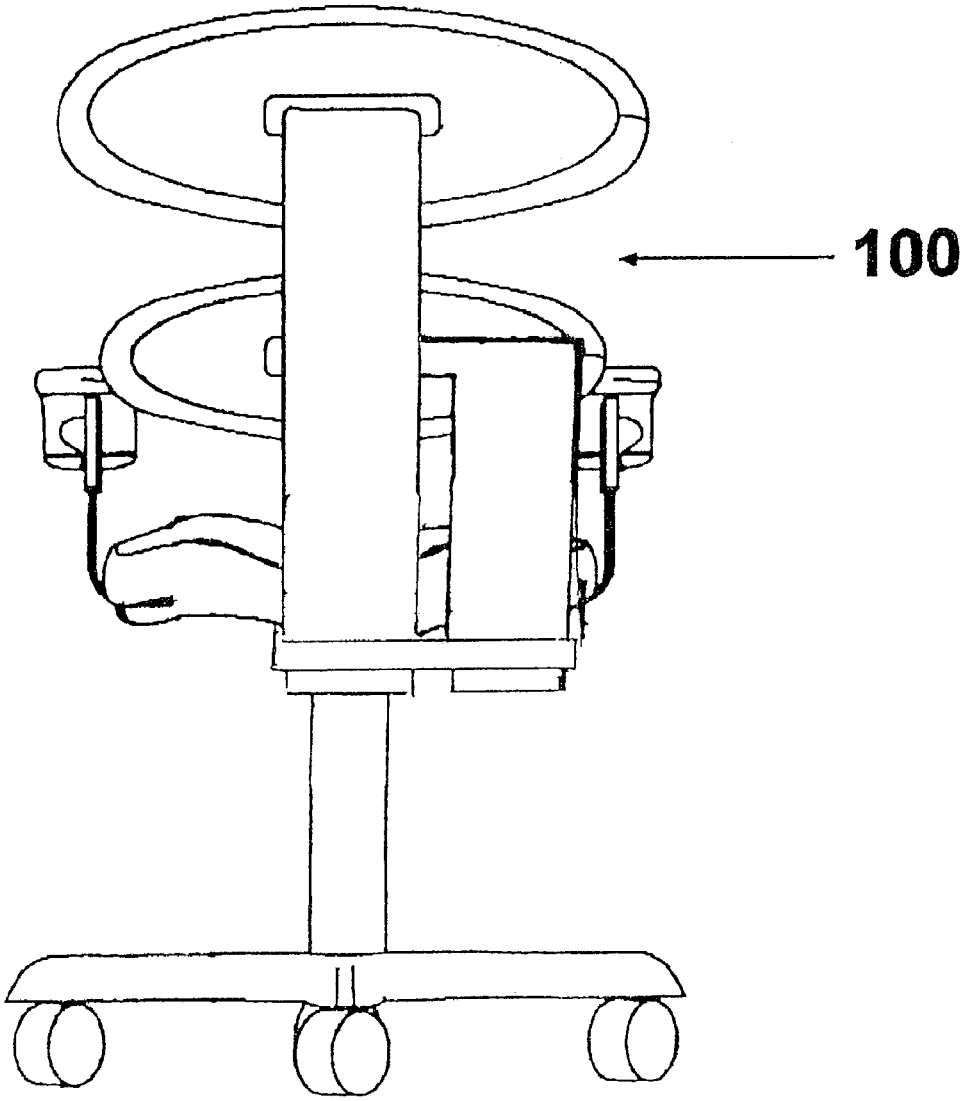
FIG. 3 is a back view of the chair of FIG. 1, illustrating two independent posterior support means with a common hinge means.
Figure 4:
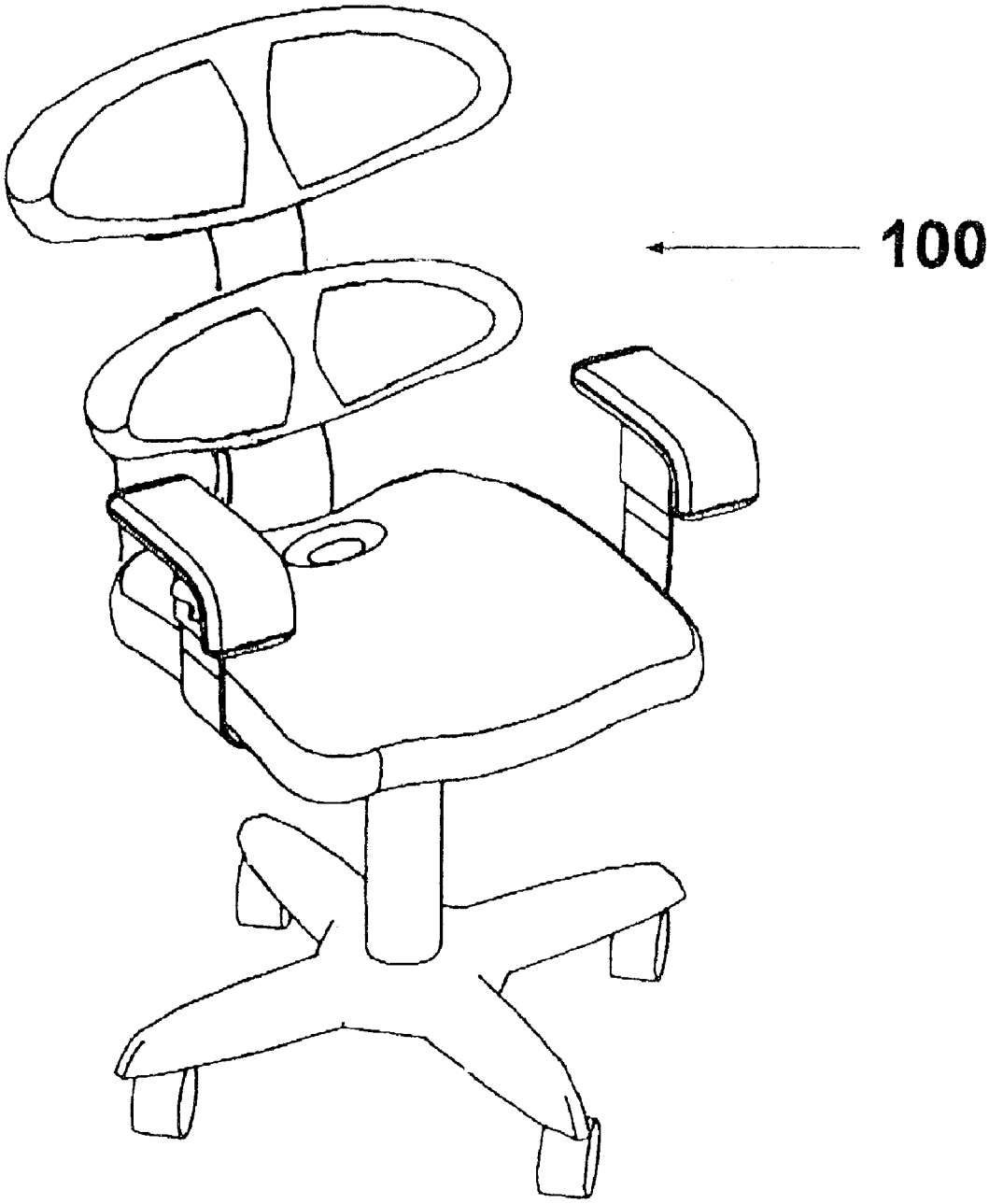
FIG. 4 is a oblique view of the chair of FIG. 1, illustrating two independent posterior support means.
Figure 5:
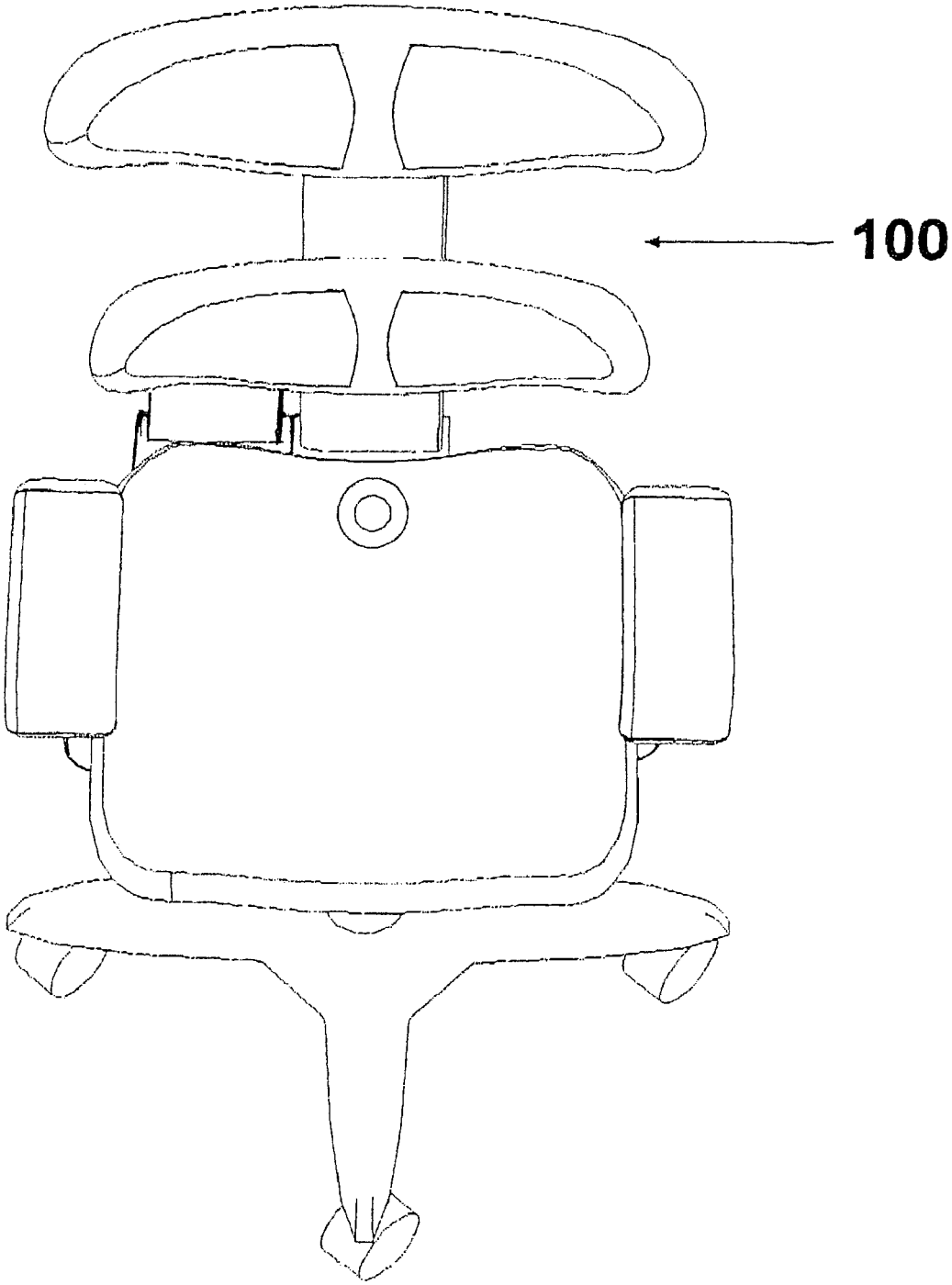
FIG. 5 is a top view of the chair of FIG. 1, illustrating two independent posterior support means.

For the purposes of the present invention, the following terms have the definitions set forth below:

"Health seating" is comprised of three dynamics which when applied in concert promote seating health. A seating device which offers: (1) adjustable support to accommodate a wide range of individual body dimensions and preferences, (2) an adaptable series of supports for various tasks to be performed in a seated position, and (3) continuous position animation which disrupts static seating while promoting active seating.

"Dynamically balanced task chair" is defined as an adjustable chair that accommodates and supports a wide range of user dimensions by supporting the body of the user while performing various tasks done from a seated position and simultaneously supporting active seating.

"Static seating" is defined as the placement of the body in a seated and inactive position for a prolonged period of time with the potential for musculoskeletal, respiratory, nervous, digestive and circulatory systems becoming comprised, dynamical and/or anatomically pressured.

"Active seating chair" is defined as a chair which enables the user to frequently adjust the supports, allowing anatomical movement for musculoskeletal, respiratory, nervous, digestive and circulatory systems to remain uncompromised, thereby efficiently functioning, unimpinged and unpressured.

"Active seating" is defined as frequent anatomical adjustments to allow the body's systems to remain active, uncompromised and functioning properly.

"Adjustment alert" is defined as a means for prompting the seating user to make adjustments to obtain "active seating". This device reminds the user to change anatomical position and make adjustments to obtain adjustments to support new positions.

"Support flexibility" is defined as the ability to alter support as seated tasks change. For example, the thoracic, posterior brace support is converted to a sternum/anterior brace for a task that requires tilting forward for an. extended period of time.

"Spinal relief channel" is defined as a vertical concave channel positioned in the middle of each support brace to eliminate direct pressure on the spinous process while promoting circulation, aeration and unimpinged nerves.

"Brace support" is defined as an adjustable horizontal brace designed to support the back (lumbar to cervix) posterior or anterior from abdomen to sternum, attached to an adjustable independent hinged spring arm arising from the seat frame.

"Anatomical pressure" is defined as the pressure that builds when in a static position for an extended period, causing muscle bracing (tension), restriction to circulation and nerve impingement (numbness).

"Vertebrae strength contour" is defined as the proper alignment contour of the vertebrae which provides the optimum anatomical support strength from sacrum to cervix.

"Coccyx relief" is defined as depression in a horizontal chair seat, which eliminates direct pressure on the coccyx, and promotes circulation, aeration and impinged nerves.

"Tilt arm rest" is defined as the support for elbow and forearm which has a forward and down tilt aspect.

"Health Task Chair" is an adjustable task chair which gives healthy muscle/skeletal anatomical support to a person performing multiple tasks while in a seated position.

"Seating Health System" is defined as a three-part system which, when properly integrated, promotes "seating health" by combining:

Adjustable EXO support skeleton,

Flexible task support, and

Continuous position animation.

"Adjustable EXO Support Skeleton" is defined as the health chair design that incorporates two or more brace supports attached to independent arms that arise from the seat frame. This design allows the individual user to make their own body adjustments by utilizing the independent adjustment flexibility of the support braces. The user has adjustable selection means for posterior support utilizing bracing support anywhere along the line of vertebrae from sacrum to cervix. The user also has the flexibility to utilize support braces to the anterior (abdomen to clavicle). The support braces have adjustment flexibility to widen or contact uniquely to the individual's dimension or preference. (See FIGS. 1 through 14.)

"Flexible task support" is defined as the health chair design that incorporates task support flexibility through adaptability. When the user requires anterior (forward) support, the seating can be reversed and support braces adjusted to accommodate the task. When the user requires elbow and lower arm support, whether anterior or posterior, the forearm support has adjustment flexibility to accommodate adjustments to the "tilt arm rest" from up to down, inwardly and outwardly, but in addition, tilting downwardly from the posterior to anterior allowing an angled support. (For example, for the task of typing, a Cornell University Study suggests a proper typing health position is relaxed upper arm and shoulder support at the elbow, while simultaneously allowing lower arm, wrist, and hand to be in straight alignment angled downwardly from the elbow. This typing posture helps prevent carpel tunnel syndrome.) (See FIGS. 1 through 14.)

"Continuous position animation" is defined as the health chair design that incorporates flexibility position animation where the user makes slight alterations in position frequently to promote seating health. Slight repositioning allows muscles to relax (debrace) and the redistributing of anatomical pressure (the pressure built by static seating). Redistributing unrestricts and expands circulation, as well as unimpinging nerves (impinged nerves become numb). (See FIGS. 1 through 14.)

"Sacrum/lumbar cradle" a lower support brace is defined as an adjustable, contoured, winged, horizontal support brace for the sacral/lumbar region of the spine.

"Sacrum/lumbar rocker arm" is defined as an adjustable, contoured, vertical support arm designed for a sacrum/lumbar cradle.

"Thoracic/cervix cradle" a upper support brace is defined as an adjustable, contoured, winged support brace for the thoracic/cervix region of the spine.

"Thoracic/cervix rocker arm" is defined as an adjustable, contoured, vertical support arm designed for a thoracic/cervix cradle.

"Bi-Thorumix Task Chair" is defined as a dynamically balanced task chair comprising two rocker arms suspending two cradle supports in such a way to support spine from cervix and sacrum regions to cause proper vertebrae strength contour.

"Independent support" is defined as two or more posterior supports that can articulate up or down, forward or back, tilt posterior or tilt anterior independent of each other.

"Interdependent support" is defined as any posterior support which is pre-formed to specific contour or shape, and/or any adjustments that are restricted by relative attachment and interdependence.

DETAILED DESCRIPTION OF THE PREFERRED EMBODIMENTS

Referring to the drawings, the Figures show various aspects of the present invention. As illustrated in FIGS. 1–5, Chair 100 includes at least two adjustable back support members, 132 and 133, secured to independent arm means, 134 and 135, respectively, which are secured to spring hinges means, 167 and 168 respectively, means, which create a seat frame means, 137, respectively. Chair 100 further includes seat, 150, attached via seat frame means, 137, to telescope pedestal, 151. Pedestal, 151, is movably supported on a floor by a plurality of casters, 152, secured to a plurality of base members, 153.

As described above, and as illustrated in the Figures, Chair 100, includes at least two adjustable back support members, 132 and 133, secured to independent arm means, 134 and 135, respectively, which are secured to spring hinge means, 167 and 168, respectively through spring loaded adjustment hinge means, 180 and 181, respectively, provided with adjustment lock means, 10 and 11.

Chair 100 includes seat 150, attached via seat frame means 137, to telescope pedestal means 151, which is movably supported on a floor by a plurality of casters, 152, secured to base members, 153.

FIGS. 6 through 14 show a further details of the invention. Chair, 100, includes two independent adjustable back support members, 132 and 133, secured to independent arm means, 134 and 135, secured to hinged means, 167,168, by adjustment means, 10,11,174,175, respectively, attached to seat frame means, 137, respectively.

Chair, 100, includes seat, 150, attached to telescope pedestal, 151, via seat frame means, 136. Pedestal, 151, is movably supported on a floor by a plurality of casters, 152, secured to a plurality of base members, 153.

Figure 6:
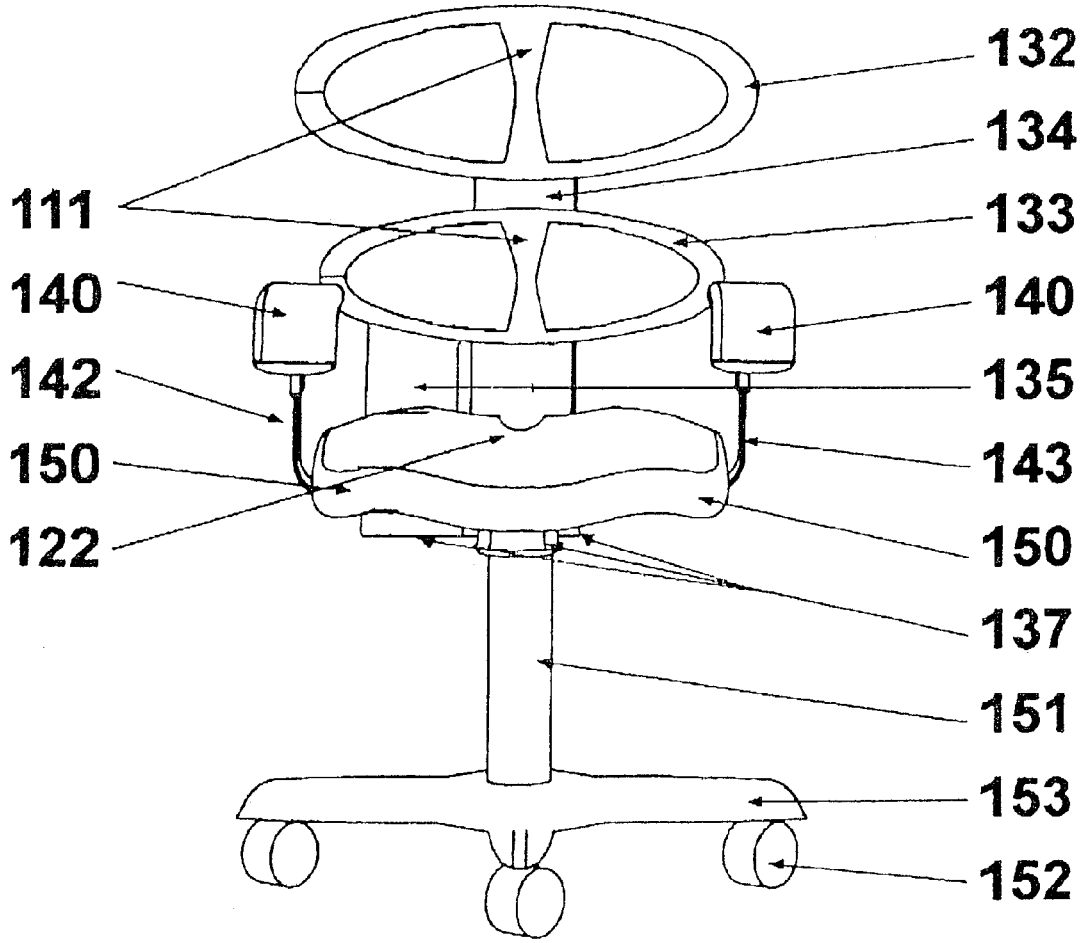
FIG. 6 is a schematic plan view of the chair of FIG. 1, illustrating the adjustable independent posterior support means provided with a spinal relief channel.

FIG. 6 shows adjustable back support members, 131 and 132, provided with spinal relief channel, 111.

Figure 7:
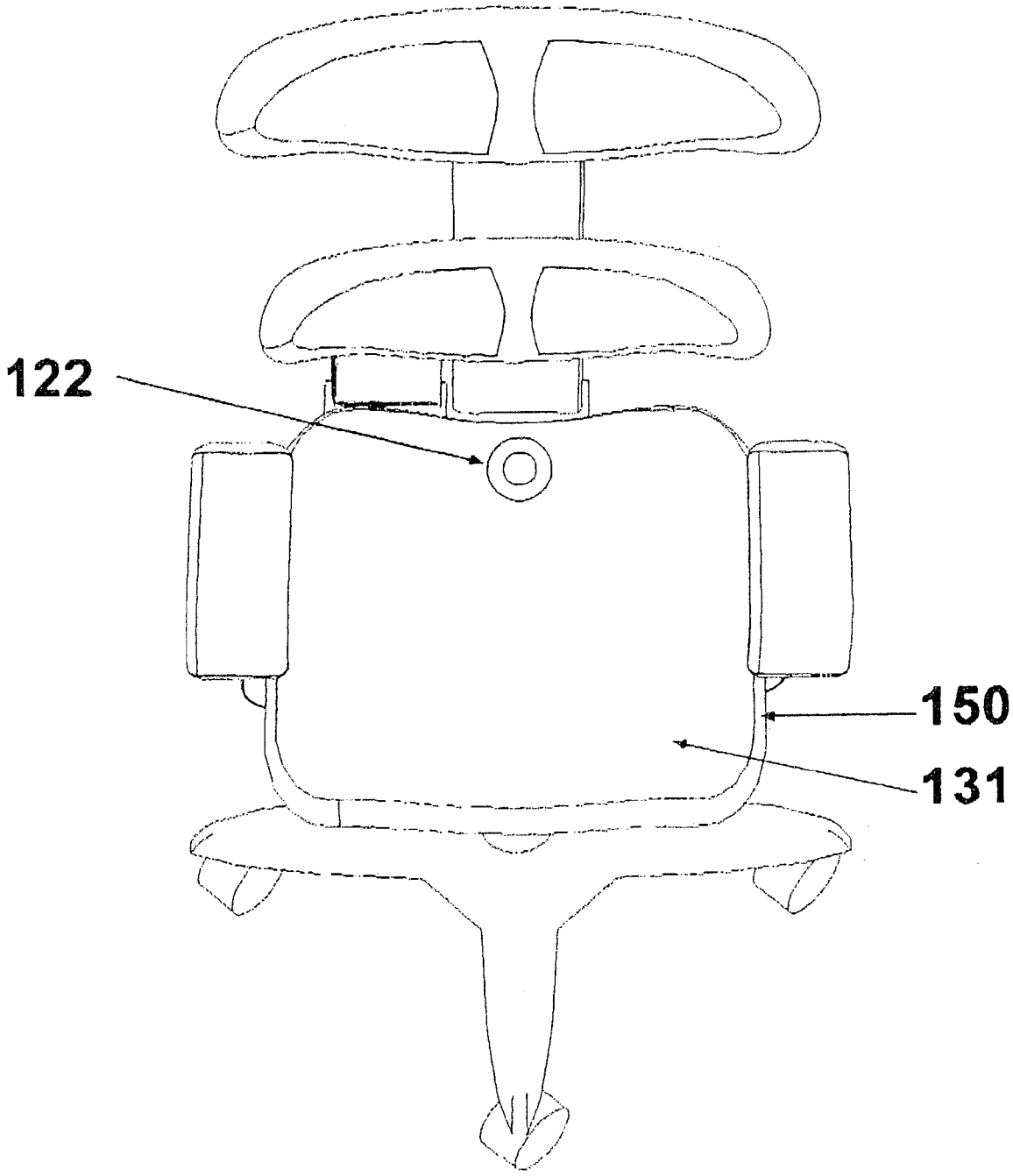
FIG. 7 is a schematic plan view of the chair of FIG. 1, illustrating the seat member seating surface provided with a coccyx relief means.
Figure 8:
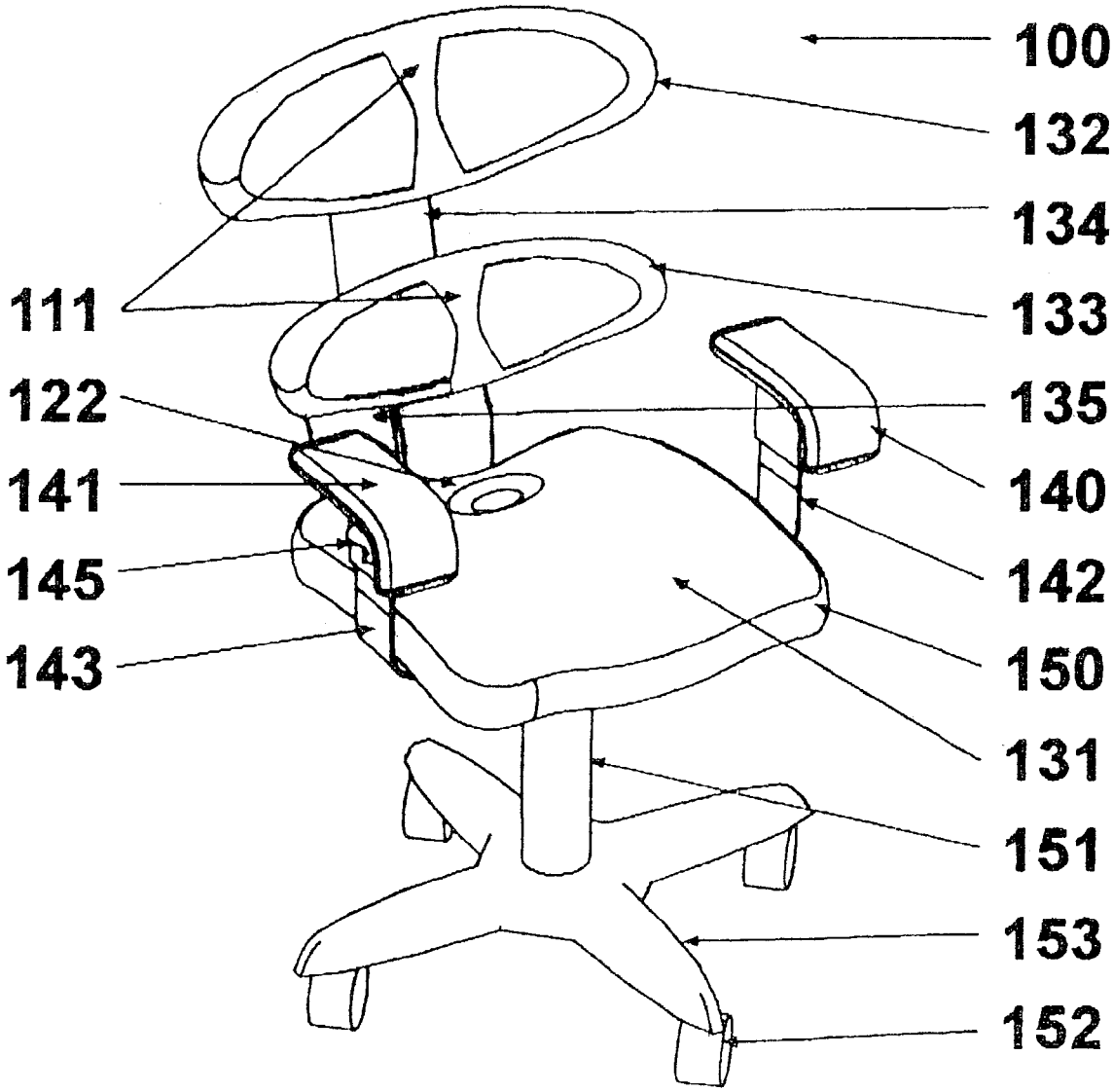
FIG. 8 is a perspective oblique view of the chair of FIG. 1, illustrating multiple support means.
Figure 9:
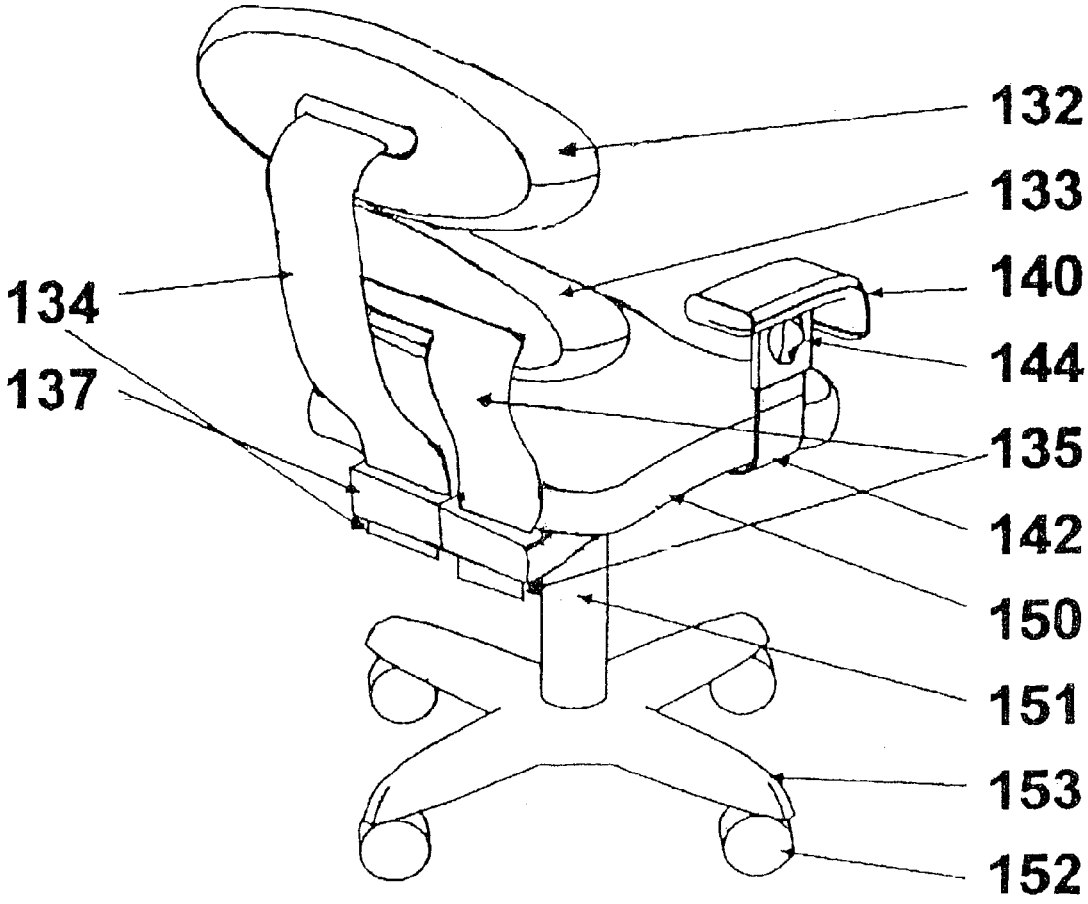
FIG. 9 is a perspective oblique back view of the chair of FIG. 8.
Figure 10:
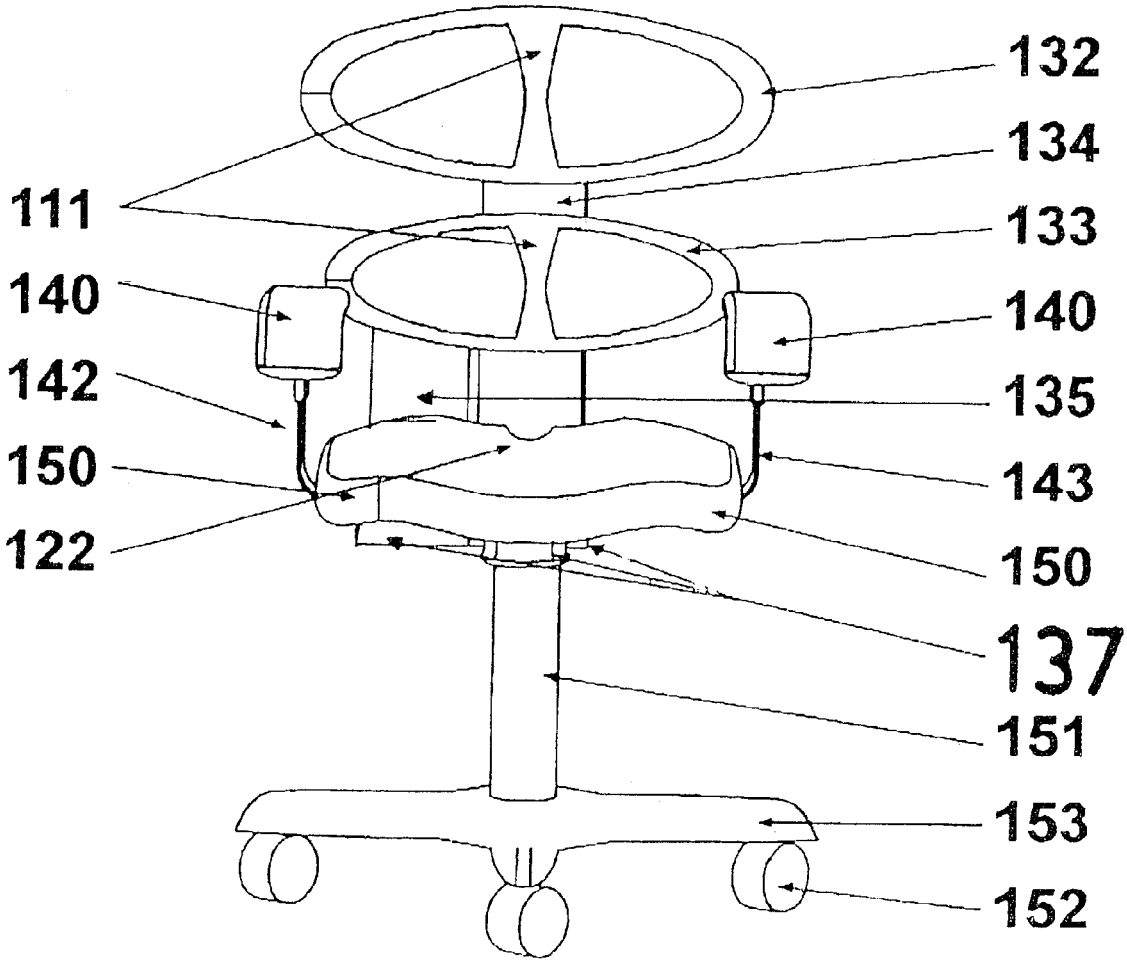
FIG. 10 is a perspective front view of the of the chair of FIG. 8, illustrating multiple support means.
Figure 11:
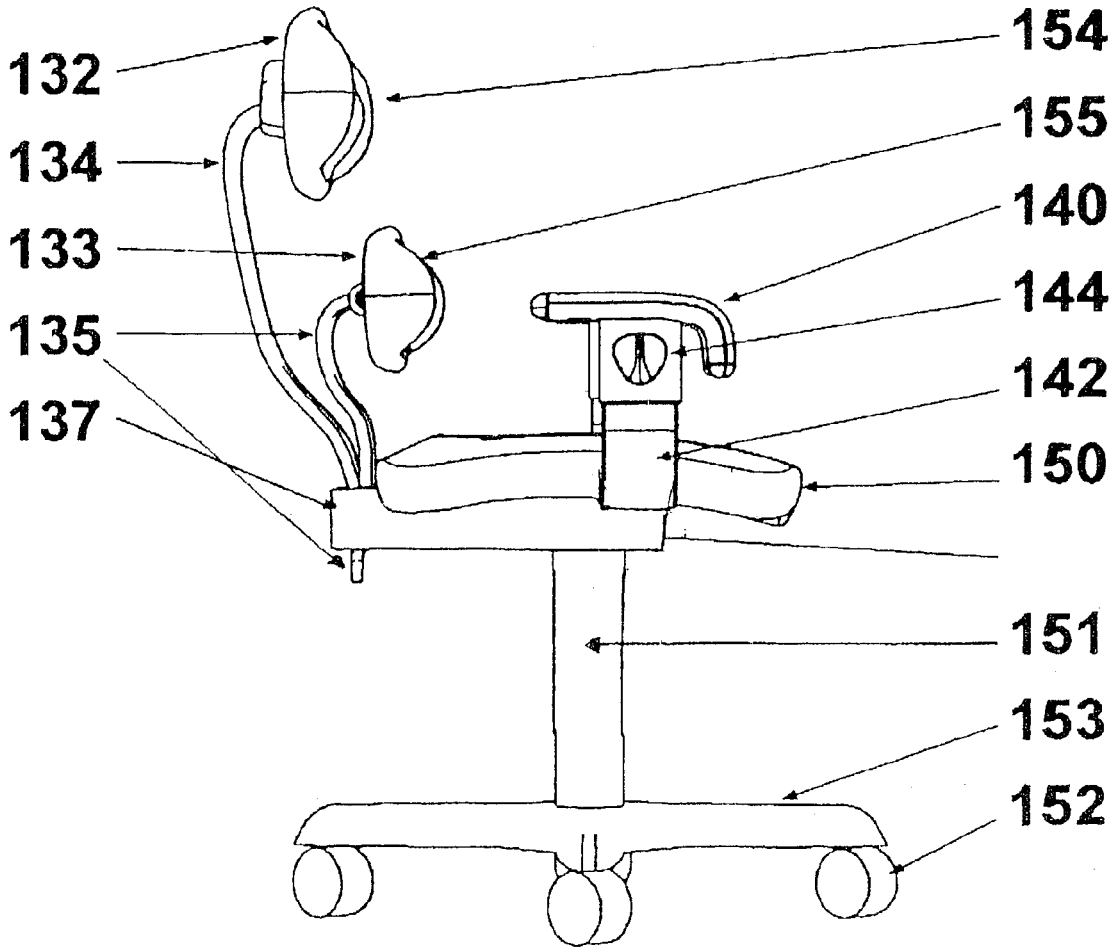
FIG. 11 is a perspective side view of the chair with multiple support means shown in FIG. 8.
Figure 12:
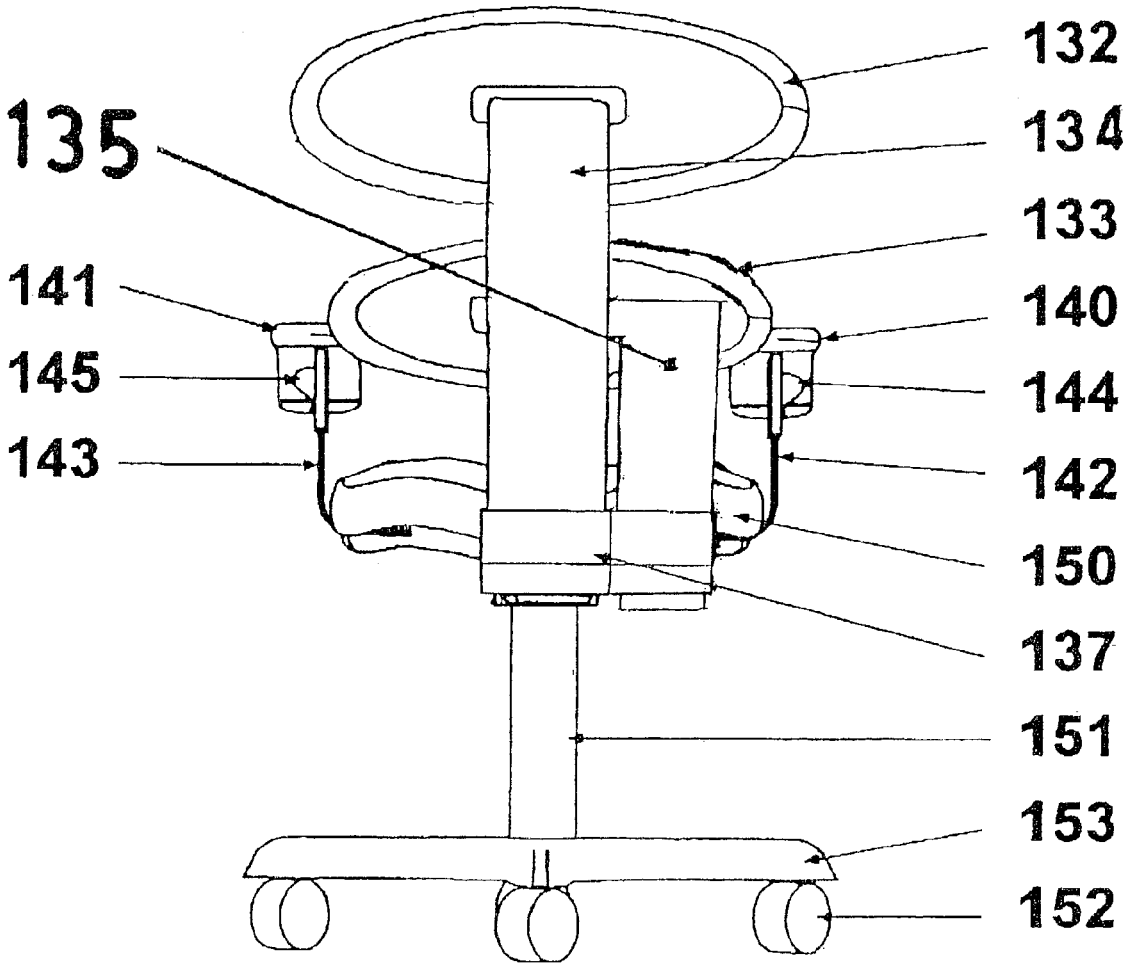
FIG. 12 is a back view of the chair with multiple support means shown in FIG. 8.

FIG. 7 shows seat surface, 131, of seat member, 150, provided with coccyx pressure relief means, 122.

FIGS. 6 through 14 show a particularly preferred embodiment of the dynamically balanced task chair of the present invention with multiple independent back support means secured to independent arm means along with adjustable forearm support means.

Specifically, chair 100, includes: two adjustable back support members, 132 and 133, respectively, which are adjustably secured to separate arm means, 134 and 135, respectively; secured to spring hinge means, 167 and 168, respectively, spring hinge means, 167 and 168, which are provide with adjustment means, 10 and 11, respectively which are secured to seat base means, 137, via attachment means, 137; two adjustable forearm support members, 140 and 141, respectively, which are secured to seat base means, 137, by forearm attachment means, 142 and 143, respectively; and forearm attachment means, 142 and 143, which are provided with forearm support adjustment means, 144 and 145, respectively.

Chair 100 includes seat 150, attached via seat frame means, 137, to telescope pedestal, 151. Pedestal, 151, is movably supported on a floor by a plurality of casters, 152, secured to a plurality of base members, 153.

Specifically chair 100, includes seat and back mechanism, 137, respectively, with seat height adjustments means, 12, respectively, seat slide and lock adjustment means, 13, respectively, seat tilt adjustment means, 14, respectively, seat tension adjustment means, 15, respectively, attached to seat control mechanism and frame support means, 137.

The need for healthy task seating is well established and this unmet need is finally met by the dynamically balanced task chair of the present invention as set forth in the Figures discussed above.

Key to healthy task seating is a series of adjustable support means that accommodate a wide range of individual body dimensions and preferences as well as a wide range of tasks to be accomplished in a seating position. These are shown in FIGS. 1 through 14.

Static seating is the antithesis of active seating, which provides means for periodic adjustments to various seat supporting members, which allow the body's systems to remain active, uncompromised and functioning properly.

Various adjustment alert means can be incorporated into the dynamically balanced task chairs of the present invention shown in the drawings. These adjustment alert means prompt the user of the task chair to make frequent adjustments to support members to support new positions.

Support flexibility is achieved by altering support for various seated tasks changes. See FIGS. 1 through 14.

Relief of anatomical pressure during seating is achieved with the adjustable EXO-support skeleton with multiple independent posterior support means as shown in the Figures discussed above.

The present invention will be further illustrated with reference to the following example which aid in the understanding of the present invention, but which is not to be construed as a limitation thereof.

EXAMPLE

One embodiment of the chair of the present invention was built from parts taken from a pair of commercially available "Full Function Executive Task Chairs" obtained from Merit Inc. of Temple, Tex.

The first step was the removal of both seat and back adjustment mechanisms (see, FIG. 13) from the pedestals. The next step was the removal of the seat and the back from adjustment mechanisms. One of the adjustment mechanisms was cut one inch past the hinged back adjustment spring paddle adjustment (see, FIG. 13, No. 10).

The next step was the welding of a plate on the exposed new end of the adjustment mechanism. Next, the paddle and spring adjustment were reversed (see, FIG. 13, No. 11). Next, the two mechanisms were aligned side by side and welded together (see, FIG. 14, No. 137).

At this point, two seat backs were removed from the task chairs and taken apart. The contoured plywood was next cut into two oval shapes. Foam padding was shaped to provide the desired Spinal Relief members (see, FIG. 10, No. 111) in middle of both Support Braces (see, FIG. 10, Nos. 132 & 133).

New contoured backs and foam padding were then upholstered to accommodate the newly created shapes. A machine shop was used to machine and form the designed contour (see, FIG. 14, No. 134) from a piece of stainless steel No. 304, ¼ inch thick, by 2 and ¼ inches wide, by 30 inches long. A piece of steel, 6 inches long, by 2 inches wide, by ¼ inch thick, was then welded perpendicularly to the top end, (see FIG. 14, No. 160). Member 160 was then drilled to accommodate two screws to permit attachment of Support Brace member 132.

Figure 14:
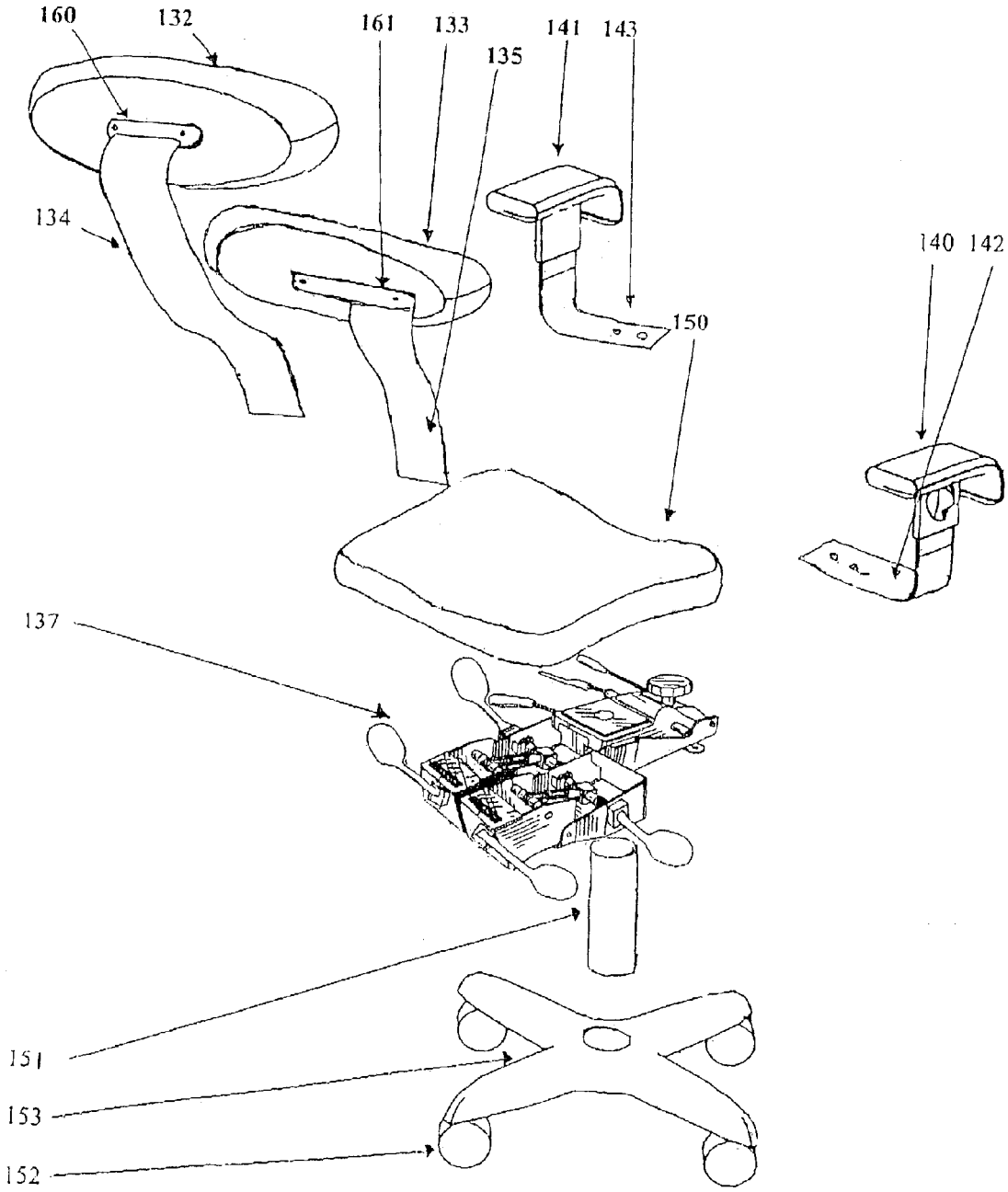
FIG. 14 is an exploded schematic plan view of chair 100.

The machine shop next machined and formed the designed contour for member 135 from a piece of stainless steel No. 304, ¼ inch thick, by 2 and ¼ inches wide by 24 inches long (see, FIG. 14, No. 135). A piece of steel, 12 inches long, by 2 inches wide, by ¼ inches thick was then welded at top of member 135 (see, FIG. 14, No. 161) at a 90 degree angle. Member 161 was then drilled to accommodate two screws to attach Support Brace No 133.

In the next step, a seat from one of original task chairs was taken apart. First the foam cushion was removed from the seat and cut—removing a circle with a diameter of 2½ inches by 1 inch deep, in which the center of the circle was 3¾ inches from the middle of posterior edge (see, FIG. 7, No. 122). This newly created foam cushion was then upholstered to accommodate the new shape (see, FIG. 7, Nos. 150, 131).

Figure 13:
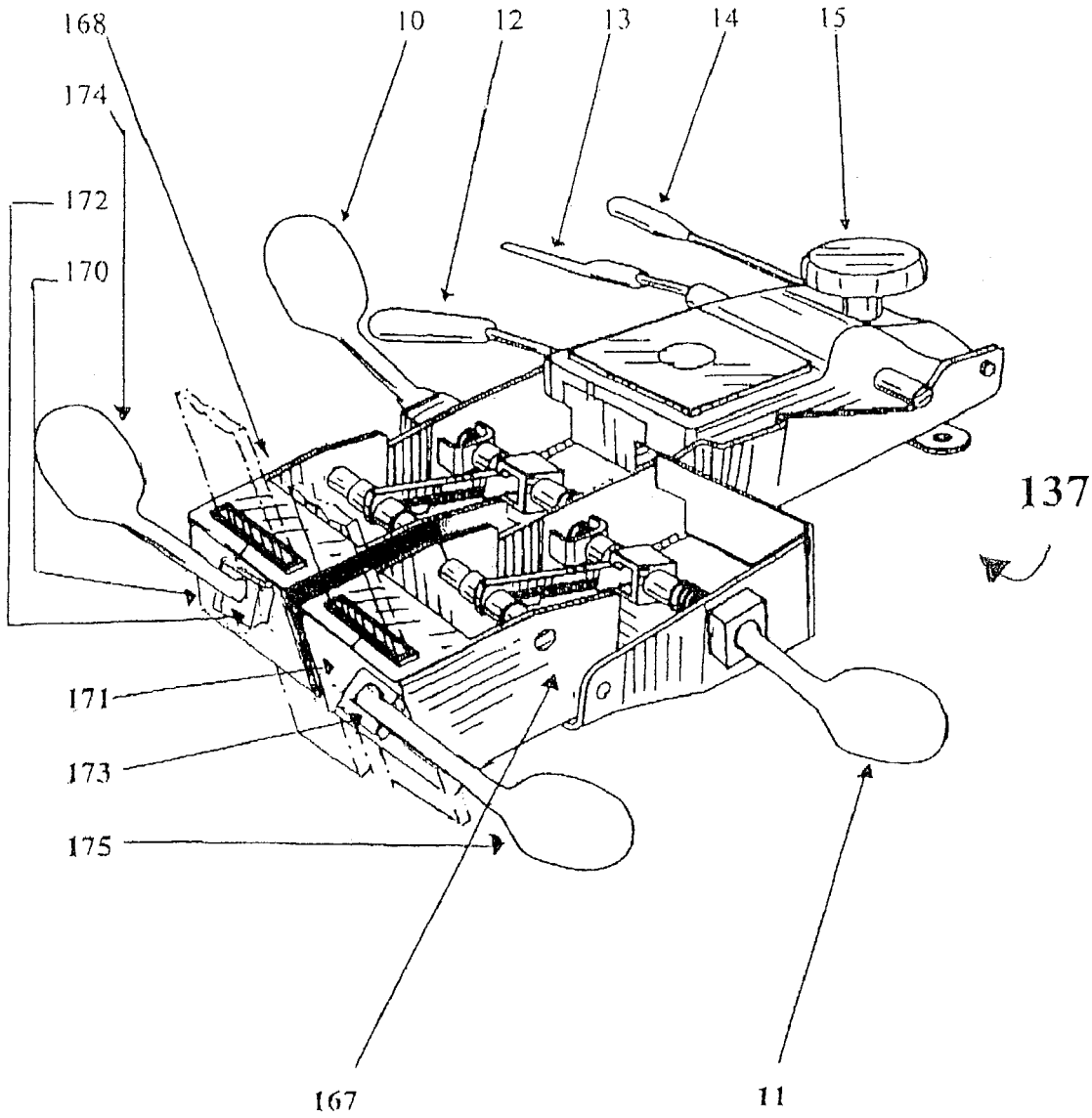
FIG. 13 is a plan view of the seat control mechanism 137, comprising seat frame adjustment means and adjustment support means.

The seat/frame control mechanism (see FIGS. 13 & 14, No. 137) was drilled creating two ½ inch holes in center and thru the outside plates (see, FIG. 13, Nos. 170 and 171). Two 7/16 inch threaded nuts were welded over the holes (see, FIG. 15, No. 172 and 173). Two tighten and release paddles (see, FIG. 14, Nos. 174 and 175) were created by welding a 7/16 inch by 1 inch threaded bolt at a right angle (90 degree) to the end of a 5 inch paddle for (No. 174) and the same process for (No. 175). The parts were then assembled as illustrated in FIG. 13, Nos. 152, 153, 151, 137, 150, 134, 135, 132, 133, 142, 143, 140, 141, thereby creating the dynamically balanced task chair of the present invention.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. An adjustable task chair comprising:

a base;

a seat comprising a seating surface supported by a frame;

at least two vertically adjustable back supports, each said adjustable back support independently supported by a vertically adjustable arm, one of said back supports supporting a lower back of a seated person and another of said back supports supporting an upper back of the seated person; and each said arm supported by said frame, pivotally attached to said frame and each said arm independently adjustable, independent of each said other arm, to adjust a position of each said back support in an anterior and a posterior direction about a pivot point irrespective of tension at a point of attachment of each said arm to said frame.

2. An adjustable task chair according to claim 1, further comprising at least two adjustable forearm supports.

3. An adjustable task chair according to claim 2, wherein said forearm supports are adjustably and connectedly integrated with said chair.

4. An adjustable task chair according to claim 1, wherein each vertically adjustable back support further comprises a spinal relief channel.

5. An adjustable task chair according to claim 1, wherein said seating surface further comprises a coccyx pressure relief depression.

6. A healthy task seating system comprising:

a base;

a seat comprising a seat frame;

at least two back supports pivotally attached to said seat frame and adjustable independent of each other in anterior and posterior positions about a pivot point irrespective of tension at a point of attachment of each said arm to said frame and adjustable in vertical positions; and wherein said adjustable back supports are integrated to promote healthy seating while the user is performing various tasks from a seated position.

7. The seating system of claim 6, wherein said back supports are adjustably and independently secured to said seat frame and are flexible to accommodate a wide range of body dimensions with integrated dynamic support.

8. The seating system of claim 6, further comprising adjustable forearm supports.

9. The seating system of claim 6 comprising at least one adjustable EXO support skeleton comprising an adjustable, contoured, hinged, horizontal sacrum/lumbar cradle support to provide horizontal support to a sacral region of a spine.

10. The seating system of claim 9, wherein said sacrum/lumbar cradle support comprises a sacrum/lumbar rocker arm member.

11. The seating system of claim 6 comprising at least one adjustable EXO support skeleton, said support skeleton comprising an adjustable, contoured, winged support brace for supporting a thoracic/cervix region of a spine.

12. The seating system of claim 11, wherein said thoracic/cervix winged support brace comprises a thoracic/cervix rocker arm member.

13. The seating system of claim 6 further comprising supports that provide for more than one seating positions.

14. The seating system of claim 6 further comprising a support system easily adjustable in more than one direction and plane.

15. A bi-thorumix, dynamically balanced task chair comprising:

a first adjustable posterior support comprising a rocker arm thoracic/cervix suspending cradle support; and a second adjustable posterior support comprising a rocker arm sacrum/lumbar suspending cradle support; and said first posterior support and said second posterior support adjustable independent of each other in anterior and posterior positions irrespective of tension at a point of attachment of each said arm to said frame and adjustable in vertical positions.

16. An adjustable task chair comprising:

a base;

a seat comprising a seating surface supported by said base;

at least two vertically adjustable back supports, each said support independently attached to said seat; and two adjustable forearm supports, wherein said back supports comprise independently adjustable spring arms and an adjustable, horizontal brace support disposed on each said arm, and wherein each said arm is independently attached to said base providing anterior and posterior adjustments about a pivot point to said horizontal brace supports irrespective of tension at a point of attachment of each said arm to said seat, said spring arms adjustable independent of each other.

17. The adjustable task chair of claim 16, wherein each said adjustable, horizontal brace support comprises a spinal relief channel.

18. The adjustable task chair of claim 16, wherein said seating surface further comprises a coccyx pressure relief depression.

* * * * *